US005400620A

United States Patent [19]

Cervo et al.

[11] Patent Number: 5,400,620

[45] Date of Patent: Mar. 28, 1995

[54] EARRING INSERT FOR A PIERCED EARLOBE AND OTHER PIERCED PARTS OF THE ANATOMY

[76] Inventors: Gerard Cervo; Judith A. Cervo, both of 102 Von Huenfeld St., Massapequa Park, N.Y. 11762

[21] Appl. No.: 94,624

[22] Filed: Jul. 21, 1993

[51] Int. Cl.[6] ..... A44C 7/00

[52] U.S. Cl. ..... 63/12

[58] Field of Search ..... 63/12, 13, 14.3

[56] References Cited

U.S. PATENT DOCUMENTS

| | | | |
|---|---|---|---|
| 161,853 | 4/1875 | Baker | 63/12 |
| 2,568,207 | 9/1951 | Spicher | 63/12 |
| 3,789,850 | 2/1974 | Ford | 63/12 |
| 4,067,341 | 6/1978 | Ivey | 63/12 |
| 5,018,365 | 5/1991 | Luceno | 63/12 |

FOREIGN PATENT DOCUMENTS

| | | | |
|---|---|---|---|
| 276197 | 7/1988 | European Pat. Off. | 63/12 |
| 2249252 | 5/1992 | United Kingdom | 63/12 |
| 8809134 | 12/1988 | WIPO | 63/12 |

*Primary Examiner*—Flemming Saether
*Attorney, Agent, or Firm*—Michael I. Kroll

[57] ABSTRACT

An earring insert is provided for a pierced earlobe and other pierced parts of the anatomy having an orifice therethrough. The insert consists of a first sleeve that is inserted into the orifice of the pierced earlobe and other pierced parts of the anatomy. A first flange extends about an outer end of the first sleeve. A second sleeve is inserted into the first sleeve. A second flange extends about an outer end of the second sleeve. A friction post and ear wire of a pierced earring can extend through the second sleeve to eliminate chaffing of the orifice, while at the same time prevent the orifice from closing, when the pierced earring is removed for a long period of time.

8 Claims, 1 Drawing Sheet

EARRING INSERT FOR A PIERCED EARLOBE AND OTHER PIERCED PARTS OF THE ANATOMY

BACKGROUND OF THE INVENTION

1. Field of the Invention

The instant invention relates generally to pierced earrings and more specifically it relates to an earring insert for a pierced earlobe and other pierced parts of the anatomy.

2. Description of the Prior Art

Numerous pierced earrings have been provided in prior art that are each adapted to be placed through an orifice in an earlobe. The insertion of and removal from the orifice of the friction post or ear wire many times can cause irritation and pain in the earlobe. While these units may be suitable for the particular purpose to which they address, they would not be as suitable for the purposes of the present invention as heretofore described.

SUMMARY OF THE INVENTION

A primary object of the present invention is to provide an earring insert for a pierced earlobe and other pierced parts of the anatomy that will overcome the shortcomings of the prior art devices.

Another object is to provide an earring insert for a pierced earlobe and other pierced parts of the anatomy that is placed through an orifice in the earlobe and the other pierced parts, so as to act as a support guide for a friction post and ear wire of a pierced earring.

An additional object is to provide an earring insert for a pierced earlobe and other pierced parts of the anatomy in which once inserted into the orifice and maintained in place, the earring insert will eliminate chaffing of the orifice, while at the same time prevent the orifice from closing.

A further object is to provide an earring insert for a pierced earlobe and other pierced parts of the anatomy that is simple and easy to use.

A still further object is to provide an earring insert for a pierced earlobe and other pierced parts of the anatomy that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Figure 3:
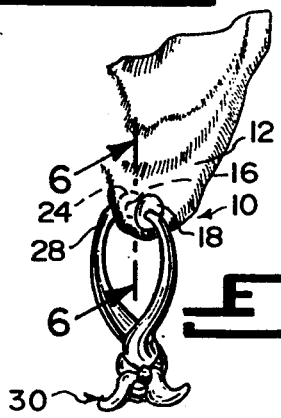
FIG. 3 is a perspective view of the earlobe with a pierced earring inserted through the instant invention.
Figure 6:
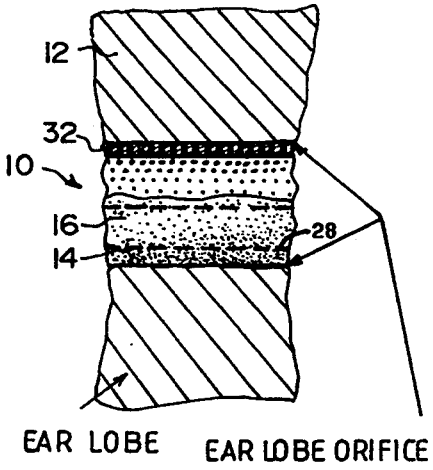

FIG. 6 a further enlarged cross sectional view taken along line 6—6 in FIG. 3, showing the vented sleeve in greater detail.

Figure 7:
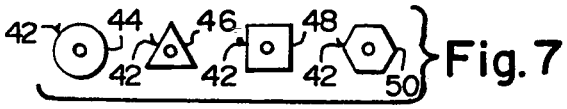
Figure 1:
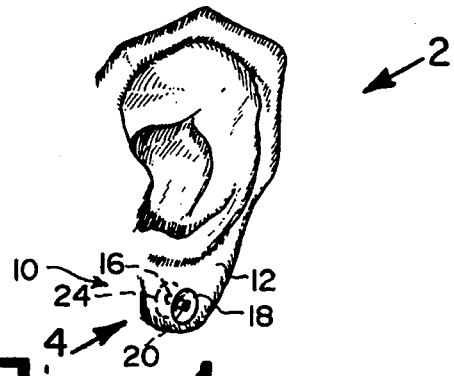
FIG. 1 is a perspective view showing the instant invention within an orifice in an earlobe.
Figure 2:
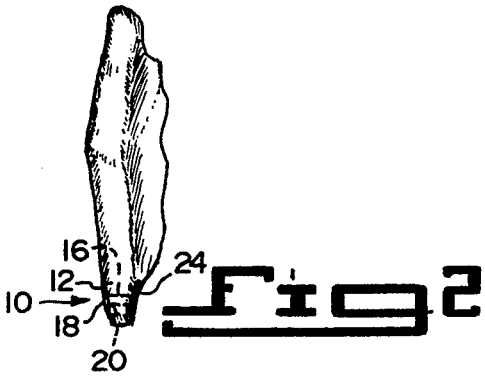
FIG. 2 is a side view taken in the direction of arrow 2 in FIG. 1.
Figure 4:
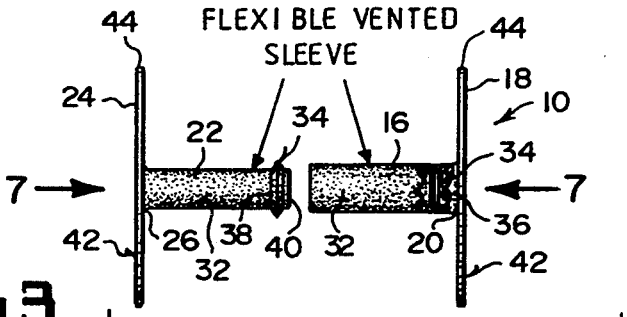
FIG. 4 is an enlarged exploded side view of the instant invention per se, with parts broken away taken in the direction of arrow 4 in FIG. 1.
Figure 5:
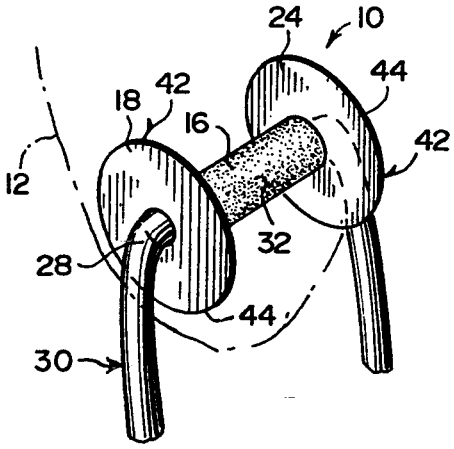
FIG. 5 is an enlarged perspective view of the instant invention assembled, showing a portion of the pierced earring and the earlobe in phantom.

FIG. 7 are end views, each taken in either direction as indicated by arrow 7 in FIG. 4, showing the flanges in different geometric shapes.

DETAILED DESCRIPTION OF THE PREFERRED EMBODIMENTS

Turning now descriptively to the drawings, in which similar reference characters denote similar elements throughout the several views, FIGS. 1 through 7 illustrate an earring insert 10 for a pierced earlobe 12 and other pierced parts of the anatomy (not shown), having an orifice 14 therethrough. The insert 10 consists of a first sleeve 16 that is inserted into the orifice 14 of the pierced earlobe 12 and other pierced parts of the anatomy. A first flange 18 extends about an outer end 20 of the first sleeve 16. A second sleeve 22 is inserted into the first sleeve 16. A second flange 24 extends about an outer end 26 of the second sleeve 22. A friction post (not shown) and ear wire 28 of a pierced earring 30 can extend through the second sleeve 22, to eliminate chaffing of the orifice 14, while at the same time prevent the orifice 14 from closing when the pierced earring 30 is removed for a long period of time.

The first sleeve 16 is fabricated out of a flexible vented material 32, while the second sleeve 22 is also fabricated out of the flexible vented material 32. The first flange 18 is integral with the first sleeve 16 and the second flange 24 is integral with the second sleeve 22. When the second sleeve 22 is inserted into the first sleeve 16, the first flange 18 and the second flange 24 will help maintain the first sleeve 16 and the second sleeve 22 in placed within the orifice 14, while the flexible vented material 32 will allow the orifice 14 to receive air to keep it dry.

The earring inserted 10, as shown in FIG. 4, further includes a structure 34 for retaining the second sleeve 22 within the first sleeve 16 when assembled together within the orifice 14. The retaining structure consists of the first sleeve 16 having an internal annular V-shaped groove 36, adjacent its outer end 20. The second sleeve 22 has an external annular V-shaped ring 38, adjacent its inner end 40. When the second sleeve 22 is inserted into the first sleeve 16, the V-shaped ring 38 will engage with the V-shaped groove 36.

The first flange 18 and the second flange 24 are each made in a specific geometric shape 42, for ornamentation. As shown in FIG. 7, the geometric shaped 42 can typically be a circle 44, a triangle 46, a square 48 and a hexagon 50. Any other geometric shaped can also be utilized.

OPERATION OF THE INVENTION

To use the earring insert 10 the following steps should be taken:

1. Place the first sleeve 16 into the orifice 14 until the first flange 18 is against the front surface of the earlobe 12.
2. Insert the second sleeve 22 into the first sleeve 16.
3. The V-shaped annular ring 38 will engage with the V-shaped annular groove 36, so as to retain the second flange 24 against the rear surface of the earlobe 12.

4. The ear wire 28 of the pierced earring 30 can now be placed through the second sleeve 22 and be suspended therefrom.
5. If a person wants to remove the earring insert 10, the second sleeve 22 can be disengaged from the first sleeve 16 by pulling the V-shaped annular ring 38 out of the V-shaped annular groove 36.
6. The second sleeve 22 can now be separated from the first sleeve 16.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An earring insert for a pierced earlobe and other pierced parts of the anatomy having an orifice therethrough, said insert comprising;

a) a first sleeve of flexible vented material that is inserted into the orifice of the pierced earlobe and other pierced parts of the anatomy;

b) a first flange extending about an outer end of said first sleeve;

c) a second sleeve of flexible vented material that is inserted into said first sleeve;

d) a second flange extending about an outer end of said second sleeve, so that a friction post and ear wire of a pierced earring can extend through said second sleeve to eliminate chaffing of the orifice, while at the same time prevent the orifice from closing when the pierced earring is removed for a long period of time; and e) means for retaining said second sleeve within said first sleeve when assembled together within the orifice comprising an internal V-shape groove formed in said first sleeve adjacent its outer end and an external V-shaped ring formed on said second sleeve adjacent its inner end, so that when said second sleeve is inserted into said first sleeve said V-shaped ring will engage with said V-shaped groove, the flexible and porous sleeves keeping the orifice dry and thereby permitting said insert to be worn and maintained in place for preventing the orifice from closing.

2. An earring insert as recited in claim 1, wherein said fist flange is integral with said first sleeve and said second flange is integral with said second sleeve, so that when said second sleeve is inserted into said first sleeve, said first flange and said second flange will help maintain said first sleeve and said second sleeve in place within the orifice, while said flexible vented material will allow the orifice to receive air to keep it dry.

3. An earring insert as recited in claim 2, further including means for retaining said second sleeve within said first sleeve when assembled together within the orifice.

4. An earring insert as recited in claim 3, wherein said first flange and said second flange are each made in a specific geometric shape for ornamentation.

5. An earring insert as recited in claim 4, wherein said geometric shape is a circle.

6. An earring insert as recited in claim 4, wherein said geometric shaped is a triangle.

7. An earring insert as recited in claim 4, wherein said geometric shape is a square.

8. An earring insert as recited in claim 4, wherein said geometric shape is a hexagon.

* * * * *